US011420844B2

(12) United States Patent
Kuroda

(10) Patent No.: US 11,420,844 B2
(45) Date of Patent: Aug. 23, 2022

(54) ELEVATOR SYSTEM

(71) Applicant: Mitsubishi Electric Corporation, Chiyoda-ku (JP)

(72) Inventor: Shinichi Kuroda, Tokyo (JP)

(73) Assignee: Mitsubishi Electric Corporation, Chiyoda-ku (JP)

( * ) Notice: Subject to any disclaimer, the term of this patent is extended or adjusted under 35 U.S.C. 154(b) by 948 days.

(21) Appl. No.: 16/093,869

(22) PCT Filed: May 17, 2016

(86) PCT No.: PCT/JP2016/064632
§ 371 (c)(1),
(2) Date: Oct. 15, 2018

(87) PCT Pub. No.: WO2017/199343
PCT Pub. Date: Nov. 23, 2017

(65) Prior Publication Data

US 2019/0084792 A1 Mar. 21, 2019

(51) Int. Cl.
*B66B 1/18* (2006.01)
*B66B 17/20* (2006.01)
*B66B 1/46* (2006.01)

(52) U.S. Cl.
CPC ..... *B66B 1/18* (2013.01); *B66B 1/468* (2013.01); *B66B 17/20* (2013.01);
(Continued)

(58) Field of Classification Search
CPC ..... B66B 1/18; B66B 1/468; B66B 17/20; B66B 2201/211; B66B 2201/4615; B66B 2201/4653; B66B 2201/4669
See application file for complete search history.

(56) References Cited

U.S. PATENT DOCUMENTS 8,958,910 B2 * 2/2015 Ichinose ..... B66B 1/2458 700/258
10,947,084 B2 * 3/2021 Fang ..... B66B 1/3461
(Continued)

FOREIGN PATENT DOCUMENTS

CN 102046506 A 5/2011
EP 2 295 361 A1 3/2011
(Continued)

OTHER PUBLICATIONS

International Search Report dated Aug. 16, 2016 in PCT/JP2016/064632 filed May 17, 2016.
(Continued)

*Primary Examiner* — Jeffrey Donels
(74) *Attorney, Agent, or Firm* — Oblon, McClelland, Maier & Neustadt, L.L.P.

(57) ABSTRACT

Provided is an elevator system capable of improving the operation efficiency of an elevator. An elevator system according to the present invention includes: first processing circuitry to receive destination floor information transmitted from a movable body having a movement mechanism and second processing circuitry and being capable of boarding and alighting from a car of an elevator, to assign the car, in which a plurality of onboard positions are set, to a call based on the destination floor information received, and to assign one of the plurality of onboard positions to one movable body based on a destination floor of the movable body. The first processing circuitry transmits to the movable body information indicative of the onboard position assigned to the movable body.

12 Claims, 3 Drawing Sheets

(52) U.S. Cl.
CPC . *B66B 2201/211* (2013.01); *B66B 2201/4615* (2013.01); *B66B 2201/4653* (2013.01); *B66B 2201/4669* (2013.01)

(56) References Cited

U.S. PATENT DOCUMENTS

| | | | | |
|---|---|---|---|---|
| 2012/0041593 | A1 | 2/2012 | Ichinose et al. | |
| 2019/0315592 | A1* | 10/2019 | Machida | G05D 1/0297 |
| 2022/0033216 | A1* | 2/2022 | Noguchi | B66B 1/468 |

FOREIGN PATENT DOCUMENTS

| | | | |
|---|---|---|---|
| JP | 2007-261753 | A | 10/2007 |
| JP | 2011-57322 | A | 3/2011 |
| JP | 2016-120977 | A | 7/2016 |

OTHER PUBLICATIONS

Combined Chinese Office Action and Search Report dated Apr. 23, 2020 in corresponding Chinese Patent Application No. 201680084867.7 (with English Translation and English Translation of Category of Cited Documents), 17 pages.
Office Action dated Dec. 15, 2020 in corresponding Chinese Patent Application No. 201680084867.7 (with English Translation), 13 pages.

* cited by examiner

ELEVATOR SYSTEM

TECHNICAL FIELD

The present invention relates to an elevator system.

BACKGROUND ART

PTL 1 shown below describes an elevator system that specifies the placement of passengers in a car of an elevator. In the elevator system, passengers are assigned to a plurality of sections set in the car based on the order in which the passengers alight from the car.

CITATION LIST

Patent Literature

[PTL 1] Japanese Patent Application Publication No. 2011-57322

SUMMARY OF INVENTION

Technical Problem

In the elevator system described in PTL 1, a plurality of passengers are assigned to one section set in the car. In the case where the plurality of passengers assigned to the same section are not lined up in accordance with the order in which the passengers alight from the car, time required to alight from the car is not reduced. Consequently, the above elevator system cannot adequately improve the operation efficiency of the elevator.

The present invention has been made in order to solve the above problem. An object thereof is to provide an elevator system capable of improving the operation efficiency of an elevator.

Solution to Problem

An elevator system according to the present invention is an elevator system including: a communication unit configured to receive destination floor information transmitted from a movable body having a movement mechanism and a movement control unit and being capable of boarding and alighting from a car of an elevator; a car assignment unit configured to assign the car, in which a plurality of onboard positions are set, to a call based on the destination floor information received by the communication unit; and an onboard position assignment unit configured to assign one of the plurality of onboard positions to one movable body based on a destination floor of the movable body, wherein the communication unit transmits to the movable body information indicative of the onboard position assigned to the movable body by the onboard position assignment unit.

Advantageous Effects of Invention

In the elevator system according to the present invention, the onboard position assignment unit assigns one onboard position to one movable body based on the destination floor of the movable body. The communication unit transmits to the movable body the information indicative of the onboard position assigned to the movable body. Consequently, according to the present invention, it is possible to improve the operation efficiency of the elevator.

DESCRIPTION OF EMBODIMENT

Figure 1:
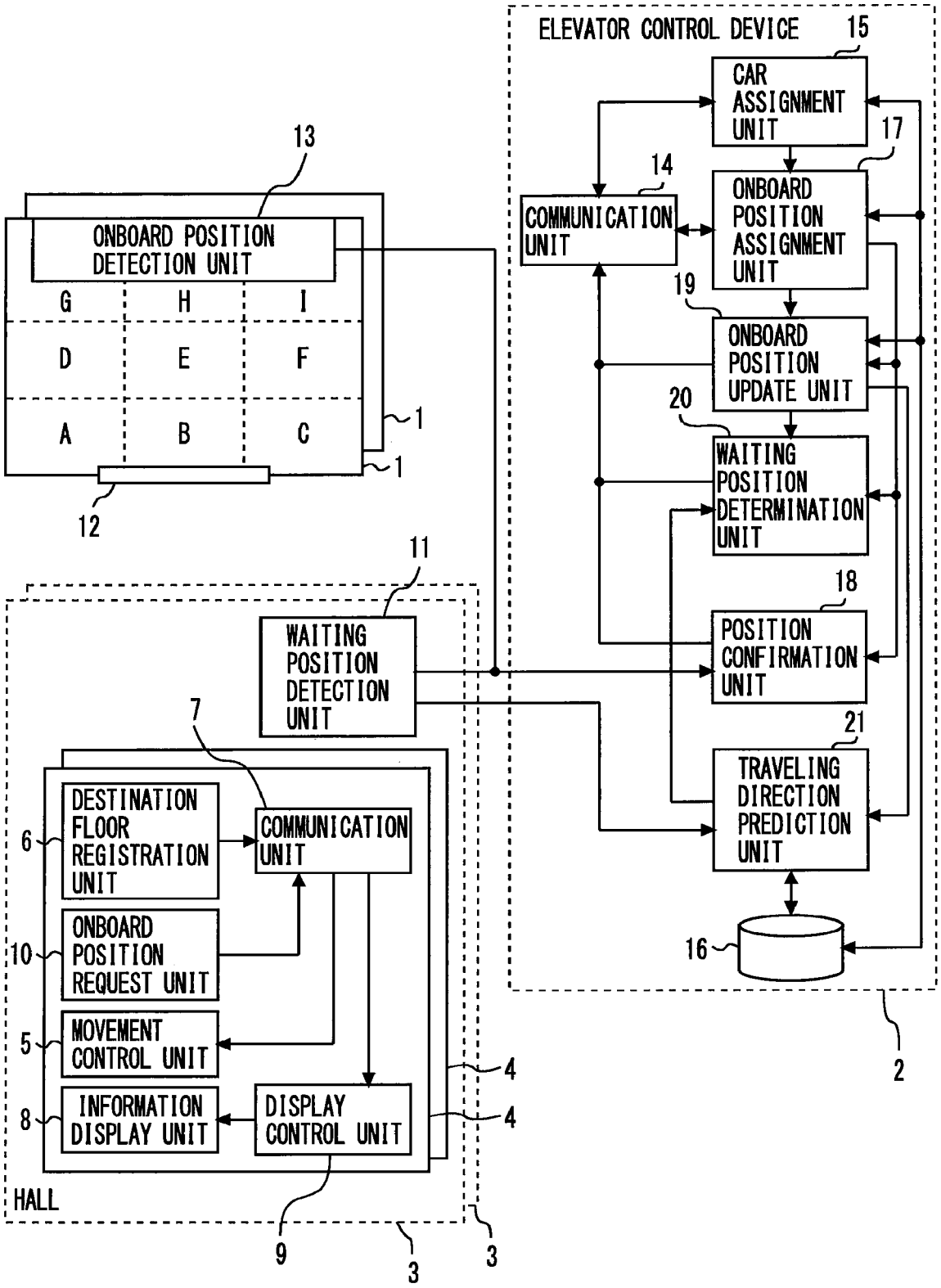
FIG. 1 is a configuration diagram showing an example of an elevator system in Embodiment 1 of the present invention.

The present invention will be described in detail with reference to the accompanying drawings. In the individual drawings, the same or corresponding parts are designated by the same reference numerals. The repeated description thereof will be appropriately simplified or omitted.

Embodiment 1

FIG. 1 is a configuration diagram showing an example of an elevator system in Embodiment 1.

The elevator system includes a car 1 of an elevator, and an elevator control device 2. For example, one car 1 is provided in each elevator. The elevator is provided in a building including a plurality of floors that is not shown. In the building, for example, a plurality of the elevators are provided. The elevator control device 2 is installed in, for example, a dedicated space provided in the building, a hoistway that is not shown, or the like. A hall 3 of the elevator is provided on a floor at which the car 1 can stop.

A movable body 4 can board and alight from the car 1. The movable body 4 is a generic name for machines, vehicles or the like each having a movement mechanism. Examples of the movable body 4 include a robot capable of moving autonomously, and a personal mobility device capable of moving while having a person on the personal mobility device. The personal mobility device may be capable of automatically moving to a destination. The personal mobility device may also be capable of moving based on an operation of a person who boards the personal mobility device.

The movable body 4 has identification information that is uniquely assigned to each movable body 4. The identification information is, for example, an ID number or the like. The identification information of the movable body 4 that allows a user to board the movable body 4 may be associated with information that identifies the user. As the identification information of the movable body 4 that allows the user to board the movable body 4, the information that identifies the user may also be set.

FIG. 1 shows a situation in which the movable body 4 is present in the hall 3. As shown in FIG. 1, the movable body 4 has a movement control unit 5, a destination floor registration unit 6, a communication unit 7, an information display unit 8, a display control unit 9, and an onboard position request unit 10. The information display unit 8 is, for example, a liquid crystal monitor, a touch panel, or the like. In the hall 3, a waiting position detection unit 11 is provided. The waiting position detection unit 11 is installed on, for example, the wall, the ceiling or the like of the hall 3. The waiting position detection unit 11 is electrically connected to the elevator control device 2.

As shown in FIG. 1, the car 1 is provided with a door 12 and an onboard position detection unit 13. The onboard position detection unit 13 is installed on, for example, the wall, the ceiling or the like in the car 1. The onboard position detection unit 13 is electrically connected to the elevator control device 2.

In the car 1, a plurality of onboard positions are preset. The onboard positions are set by, for example, equally dividing the floor surface of the car 1 by the capacity of the car 1. As an example, FIG. 1 shows the case where the capacity of the car 1 is nine persons. In this case, nine onboard positions that correspond to onboard positions A to I are set in the car 1. Among the nine onboard positions shown in FIG. 1, the onboard positions A, B, and C are closest to the door 12 in a direction toward the rear of the car, as viewed from the side of the door 12. Among the nine onboard positions shown in FIG. 1, the onboard positions G, H, and I are farthest from the door 12 in the direction toward the rear of the car, as viewed from the side of the door 12.

As shown in FIG. 1, the elevator control device 2 has a communication unit 14, a car assignment unit 15, a data storage unit 16, an onboard position assignment unit 17, a position confirmation unit 18, an onboard position update unit 19, a waiting position determination unit 20, and a traveling direction prediction unit 21. The elevator control device 2 has a function of controlling a hoist for causing the car 1 to ascend and descend that is not shown. The elevator control device 2 has a function of controlling equipment installed in the car 1 that is not shown, equipment installed in the hall 3 that is not shown, and the like.

The communication unit 7 of the movable body 4 has a function of performing wireless communication with the communication unit 14 of the elevator control device 2. That is, the movable body 4 performs wireless communication with the elevator control device 2. The wireless communication denotes communication by, for example, a wireless LAN, Wi-Fi, Bluetooth (registered trademark), and the like.

The movement control unit 5 moves the movable body 4 by operating the movement mechanism of the movable body. The movement control unit 5 moves the movable body 4, for example, automatically. The movement control unit 5 moves the movable body 4 based on, for example, an operation by the user on the movable body 4.

The destination floor registration unit 6 outputs destination floor information indicative of the destination floor of the movable body 4. The destination floor information may be, for example, preset. The destination floor information may also be set by, for example, the operation by the user on the movable body 4.

When the destination floor information is outputted from the destination floor registration unit 6, the communication unit 7 of the movable body 4 transmits the destination floor information and the ID number of the movable body 4 to the communication unit 14 of the elevator control device 2. The communication unit 14 of the elevator control device 2 receives the destination floor information and the ID number of the movable body 4 transmitted from the movable body 4.

The elevator control device 2 receives the destination floor information and the ID number of the movable body 4 from the movable body 4, and a call for movement to the destination floor of the movable body 4 with a floor on which the movable body 4 is positioned serving as a boarding floor is thereby generated. That is, the elevator control device 2 detects the floor on which the call by the movable body 4 is generated, and the ID number of the movable body 4. The floor on which the movable body 4 is positioned may be pre-stored in, for example, the movable body 4 or the elevator control device 2. The floor on which the movable body 4 is positioned may be derived from, for example, a movement history stored in the movable body 4 or the elevator control device 2. In the case where equipment that relays wireless communication is installed on each floor in the building, the floor on which the movable body 4 is positioned may be detected based on, for example, the installation floor of the equipment. The floor on which the movable body 4 is positioned may be inputted, for example, by the user on the movable body 4.

The car assignment unit 15 assigns the car 1 to the call based on the destination floor information received by the communication unit 14. The car assignment unit 15 selects the car 1 to be assigned to the call based on the floor position, the number of passengers and the like of each car 1 when the call is generated.

The data storage unit 16 stores an onboard map of each car 1. The onboard map is information indicating whether the movable body 4 is positioned or will be positioned at each of the onboard positions set in the corresponding car 1. The content of the onboard map is updated by, for example, the onboard position assignment unit 17, the onboard position update unit 19, and the like.

Table 1 shown below indicates a first example of the onboard map in Embodiment 1. Table 2 shown below indicates a second example of the onboard map in Embodiment 1. The onboard map shown in Table 1 is related to the nine onboard positions shown in FIG. 1.

TABLE 1

| onboard position | ID number |
|---|---|
| A | |
| B | |
| C | |
| D | |
| E | |
| F | |
| G | 000001 |
| H | |
| I | 000002 |

As shown in Table 1, in the onboard map, the onboard position at which the movable body 4 is present is associated with the ID number of the movable body 4. Table 1 indicates that two movable bodies 4 are in the car 1. According to Table 1, the movable body 4 having the ID number "000001" is positioned on the left on the far side toward the rear of the car, as viewed from the side of the door 12. According to Table 1, the movable body 4 having the ID number "000002" is positioned on the right on the far side toward the rear of the car, as viewed from the side of the door 12.

The onboard position assignment unit 17 assigns one of the onboard positions set in the car 1 assigned to the call to one movable body 4. The onboard position assignment unit 17 assigns the onboard position that is not associated with the ID number in the onboard map to the movable body 4. That is, the onboard position assignment unit 17 does not assign the same onboard position to a plurality of the movable bodies 4 in the same car 1 at the same time. When the onboard position assignment unit 17 assigns the onboard position to the movable body 4, the onboard position assignment unit 17 writes the ID number of the movable body 4 as the ID number corresponding to the onboard position of the onboard map.

For example, in the case where the number of floors involved in the movement from the boarding floor of the movable body 4 to the destination floor exceeds a reference value, the onboard position assignment unit 17 assigns to the movable body 4 the onboard position on the far side toward the rear of the car 1. For example, in the case where the number of floors involved in the movement from the boarding floor of the movable body 4 to the destination floor is not more than the reference value, the onboard position assignment unit 17 assigns the onboard position near the door 12 of the car 1 to the movable body 4. For example, when the onboard position assignment unit 17 assigns the onboard positions in the same car 1 to a plurality of the movable bodies 4, the onboard position assignment unit 17 assigns the onboard position closer to the door 12 of the car 1 to the movable body 4 having a floor, at which the car 1 arrives earlier, as the destination floor.

The communication unit 14 of the elevator control device 2 transmits information indicative of the onboard position assigned to the movable body 4 by the onboard position assignment unit 17 to the communication unit 7 of the movable body 4. The communication unit 7 of the movable body 4 receives the information indicative of the onboard position transmitted from the elevator control device 2. The display control unit 9 of the movable body 4 causes the information display unit 8 to display the information indicative of the onboard position.

When the car 1 assigned to the call arrives at the hall 3, the movement control unit 5 of the movable body 4 having received the onboard position moves the movable body 4 to the onboard position in the car 1, for example, automatically. When the car 1 assigned to the call arrives at the hall 3, the movement control unit 5 of the movable body 4 having received the onboard position moves the movable body 4 to the onboard position in the car 1 based on, for example, the operation by the user on the movable body 4.

The onboard position detection unit 13 detects the position of the movable body 4 in the car 1. In an example shown in FIG. 1, the onboard position detection unit 13 detects which one of the onboard positions A to I the movable body 4 in the car 1 is present at. As the detection method of the position of the movable body 4, it is possible to use, for example, a technique that uses an infrared sensor, an image recognition technique that uses a camera, or the like. The onboard position detection unit 13 transmits information indicative of the detected position of the movable body 4 to the elevator control device 2.

The onboard position detection unit 13 may further detect the ID number of the movable body 4 in the car 1 or the information that identifies the user on the movable body 4. The onboard position detection unit 13 may transmit the detected ID number or the detected information that identifies the user to the elevator control device 2.

In the case where the movable body 4 that moves based on the operation by the user on the movable body 4 boards the car 1, the position confirmation unit 18 performs onboard position confirmation. The onboard position confirmation is to determine whether or not the onboard position assigned to the movable body 4 is different from the position of the movable body 4 detected by the onboard position detection unit 13. Note that, in the case where the movable body 4 that moves automatically boards the car 1, the onboard position confirmation by the position confirmation unit 18 is not essential.

In the case where it is determined that the onboard position assigned to the movable body 4 is different from the position of the movable body 4 as the result of the onboard position confirmation, the communication unit 14 of the elevator control device 2 retransmits the information indicative of the onboard position assigned to the movable body 4 to the movable body 4. Every time the communication unit 7 of the movable body 4 receives the information indicative of the onboard position, the display control unit 9 of the movable body 4 causes the information display unit 8 to display the information indicative of the onboard position.

The onboard position update unit 19 sequentially changes the onboard position of the movable body 4 in the car 1 based on the onboard map. For example, in the case where the current onboard position of the movable body 4 that alights from the car 1 at the next stop floor is not adjacent to the door 12 and the onboard position adjacent to the door 12 is available, the onboard position update unit 19 sets the onboard position adjacent to the door 12 as the new onboard position of the movable body 4. That is, for example, the onboard position update unit 19 changes the onboard position assigned to the movable body 4 having the next stop floor of the car 1 as the destination floor to another onboard position closer to the door 12 of the car 1.

For example, in the case where the current onboard map has the content shown in Table 1 and the movable body 4 having the ID number "000001" alights from the car 1 at the next stop floor, the onboard position update unit 19 writes "000001" as the ID number corresponding to the onboard position adjacent to the door 12. That is, the onboard position update unit 19 updates the onboard map to the content shown in Table 2 shown below. In addition, in the case where the onboard position on the far side toward the rear of the car 1 becomes available due to the update, the onboard position update unit 19 updates the onboard map such that the onboard position on the farther side is assigned to the movable body 4 having the farther destination floor.

TABLE 2

| onboard position | ID number |
|---|---|
| A | |
| B | 000001 |
| C | |
| D | |
| E | |
| F | |
| G | |
| H | |
| I | 000002 |

In the case where the onboard position of the movable body 4 is updated by the onboard position update unit 19, the communication unit 14 of the elevator control device 2 transmits information indicative of the updated onboard position to the movable body 4. Every time the communication unit 7 of the movable body 4 receives the information indicative of the updated onboard position, the display control unit 9 of the movable body 4 causes the information display unit 8 to display the information indicative of the updated onboard position.

The position confirmation unit 18 also performs the onboard position confirmation in the case where the onboard position of the movable body 4 that moves based on the operation by the user on the movable body 4 is updated. Note that, in the case where the onboard position of the movable body 4 that moves automatically is updated, the onboard position confirmation by the position confirmation unit 18 is not essential.

The waiting position determination unit 20 determines the position in the hall 3 where the movable body 4 present in the hall 3 of the next stop floor of the car 1 is caused to wait. In the case where the movable body 4 is not present in the hall 3, the waiting position determination unit 20 does not operate. The presence or absence of the movable body 4 in each hall 3 is determined based on the call detected by the elevator control device 2 at the present time.

In the case where the movable body 4 having the next stop floor of the car 1 as the destination floor is not in the car 1, the waiting position determination unit 20 determines that the position in front of the door of the hall 3 is the waiting position. In the case where the movable body 4 having the next stop floor of the car 1 as the destination floor is in the car 1, the waiting position determination unit 20 determines that the position other than the position in front of the door of the hall 3 is the waiting position. The position other than the position in front of the door of the hall 3 is, for example, a position on each side of the door, a position spaced from the door by a predetermined distance or more in the front direction of the door, or the like.

The communication unit 14 of the elevator control device 2 transmits information indicative of the waiting position of the movable body 4 determined by the waiting position determination unit 20 to the communication unit 7 of the movable body 4. The communication unit 7 of the movable body 4 receives the information indicative of the waiting position transmitted from the elevator control device 2. The display control unit 9 of the movable body 4 causes the information display unit 8 to display the information indicative of the waiting position.

The movement control unit 5 of the movable body 4 having received the waiting position in the hall 3 moves the movable body 4 to the waiting position in the hall 3, for example, automatically. The movement control unit 5 of the movable body 4 having received the waiting position in the hall 3 moves the movable body 4 to the waiting position in the hall 3 based on, for example, the operation by the user on the movable body 4.

The waiting position detection unit 11 detects the position and the movement of the movable body 4 present in the hall 3. As the detection method of the position of the movable body 4, it is possible to use, for example, a technique that uses an infrared sensor, an image recognition technique that uses a camera, or the like. The waiting position detection unit 11 transmits information indicative of the detected position of the movable body 4 to the elevator control device 2.

The waiting position detection unit 11 may further detect the ID number of the movable body 4 present in the hall 3 or the information that identifies the user on the movable body 4. The waiting position detection unit 11 may transmit the detected ID number or the detected information that identifies the user to the elevator control device 2.

In the case where the waiting position of the movable body 4 that moves based on the operation by the user on the movable body 4 is determined by the waiting position determination unit 20, the position confirmation unit 18 performs waiting position confirmation. The waiting position confirmation is to determine whether or not the determined waiting position of the movable body 4 is different from the position of the movable body 4 detected by the waiting position detection unit 11. Note that, in the case where the waiting position of the movable body 4 that moves automatically is determined, the waiting position confirmation by the position confirmation unit 18 is not essential.

In the case where it is determined that the determined waiting position of the movable body 4 is different from the position of the movable body 4 in the hall 3 as the result of the waiting position confirmation, the communication unit 14 of the elevator control device 2 retransmits the information indicative of the waiting position of the movable body 4 determined by the waiting position determination unit 20 to the movable body 4. Every time the communication unit 7 of the movable body 4 receives the information indicative of the waiting position, the display control unit 9 of the movable body 4 causes the information display unit 8 to display the information indicative of the waiting position.

Note that, in the case where the movable body 4 having the next stop floor of the car 1 as the destination floor is in the car 1, the waiting position determination unit 20 may determine that a position in a direction different from the predicted traveling direction of the movable body 4 is the waiting position. For example, in the case where it is predicted that the movable body 4 travels to the right of the door of the hall 3 after alighting from the car, the waiting position determination unit 20 may determine that the left side of the door is the waiting position. The traveling direction of the movable body 4 after the movable body 4 alights from the car is predicted by the traveling direction prediction unit 21.

The traveling direction prediction unit 21 predicts the direction in which the movable body 4 travels after alighting from the car 1 based on movement direction information stored in the data storage unit 16. The movement direction information corresponds to a history indicative of the direction in the hall 3 in which the movable body 4 traveled after alighting from the car 1 previously. The movement direction information is stored for each floor of the building. The movement direction information is stored, for example, for each ID number of the movable body 4 or each piece of the information that identifies the user. As the traveling direction of the movable body 4 after the movable body 4 alights from the car 1, the traveling direction prediction unit 21 selects a direction that is most frequently indicated in the movement direction information of the movable body 4 serving as a target or the user of the movable body 4 as the result of the prediction. For example, in the case where the date and time when the movable body 4 got off the car 1 is included in the movement direction information, the traveling direction prediction unit 21 may predict the traveling direction of the movable body 4 after the movable body 4 alights from the car 1 based on the current time of day.

The movement direction information is obtained by detecting the movement direction of the movable body 4 after the movable body 4 alights at the hall 3 by the waiting position detection unit 11. The waiting position detection unit 11 transmits the movement direction of the movable body 4 after the movable body 4 alights from the car 1 to the traveling direction prediction unit 21 in association with the ID number of the movable body 4 or the information that identifies the user on the movable body 4. The traveling direction prediction unit 21 updates the movement direction information by writing the information received from the waiting position detection unit 11 in the data storage unit 16.

Figure 2:
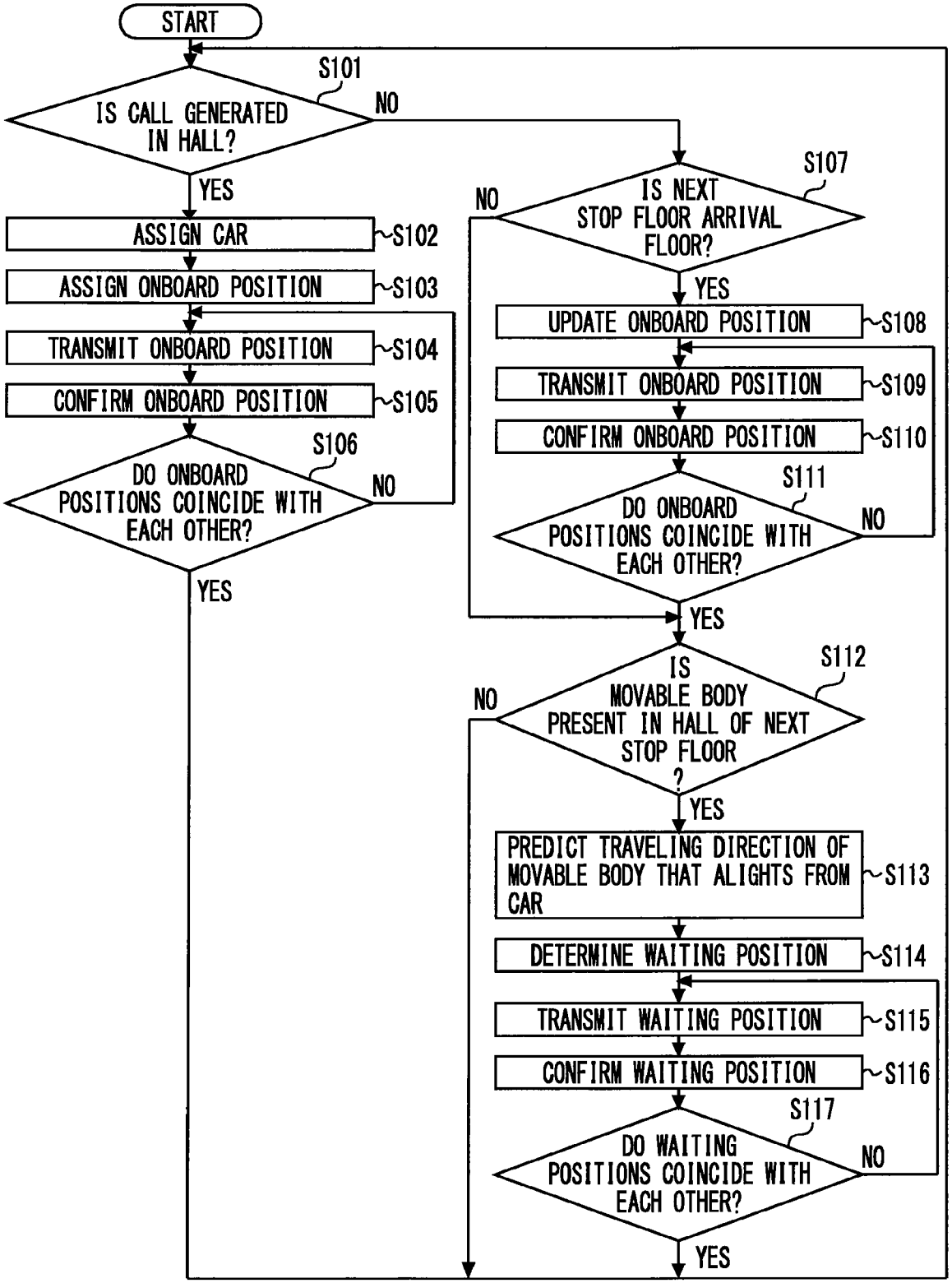
FIG. 2 is a flowchart showing an example of the operation of an elevator control device in Embodiment 1 of the present invention.

FIG. 2 is a flowchart showing an example of the operation of the elevator control device in Embodiment 1.

The elevator control device 2 determines whether or not a new call is generated in the hall 3 (Step S101). In the case where it is determined that the new call is generated in Step S101, the elevator control device 2 performs the assignment of the car 1 (Step S102). Subsequently to Step S102, the elevator control device 2 assigns the onboard position to the movable body 4 having generated the call (Step S103). Subsequently to Step S103, the elevator control device 2 transmits the onboard position to the movable body 4 (Step S104). After the movable body 4 boards the car 1, the elevator control device 2 performs the onboard position confirmation (Step S105), and determines whether or not the onboard position at which the movable body 4 is present coincides with the assigned onboard position (Step S106).

In the case where it is determined that the onboard positions don't coincide with each other in Step S106, the elevator control device 2 performs the process in Step S104. In the case where it is determined that the onboard positions coincide with each other in Step S106, the elevator control device 2 performs the process in Step S101.

In the case where it is determined that the new call is not generated in Step S101, the elevator control device 2 determines whether or not the next stop floor is an arrival floor (Step S107). The arrival floor is the floor at which the movable body 4 in the car 1 alights from the car 1. In the case where it is determined that the next stop floor is the arrival floor in Step S107, the elevator control device 2 performs the update of the onboard position (Step S108). Subsequently to Step S108, the elevator control device 2 transmits the onboard position to the movable body 4 (Step S109). Subsequently to Step S109, the elevator control device 2 performs the onboard position confirmation (Step S110), and determines whether or not the onboard position at which the movable body 4 is present coincides with the assigned onboard position (Step S111).

In the case where it is determined that the onboard positions don't coincide with each other in Step S111, the elevator control device 2 performs the process in Step S109. In the case where it is determined that the onboard positions coincide with each other in Step S111, the elevator control device 2 performs a process in Step S112. In the case where it is determined that the next stop floor is not the arrival floor in Step S107 as well, the elevator control device 2 also performs the process in Step S112.

In Step S112, the elevator control device 2 determines whether or not the movable body 4 is present in the hall 3 of the next stop floor. In the case where it is determined that the movable body 4 is present in the hall 3 of the next stop floor in Step S112, the elevator control device 2 predicts the traveling direction of the movable body 4 that alights from the car 1 at the next stop floor (Step S113). Subsequently to Step S113, the elevator control device 2 determines the waiting position in the hall 3 of the next stop floor (Step S114). Subsequently to Step S114, the elevator control device 2 transmits the waiting position to the movable body 4 that is present in the hall 3 of the next stop floor (Step S115). Subsequently to Step S115, the elevator control device 2 performs the waiting position confirmation (Step S116), and determines whether or not the position at which the movable body 4 is present in the hall 3 coincides with the determined waiting position (Step S117).

In the case where it is determined that the waiting positions don't coincide with each other in Step S117, the elevator control device 2 performs the process in Step S115. In the case where it is determined that the waiting positions coincide with each other in Step S117, the elevator control device 2 performs the process in Step S101. In the case where it is determined that the movable body 4 is not present in the hall 3 of the next stop floor in Step S112 as well, the elevator control device 2 also performs the process in Step S101.

In Embodiment 1, the communication unit 14 of the elevator control device 2 receives the destination floor information transmitted from the movable body 4 that has the movement mechanism and the movement control unit 5 and is capable of boarding and alighting from the car 1 of the elevator. The car assignment unit 15 assigns the car 1 in which a plurality of the onboard positions are set to the call based on the destination floor information received by the communication unit 14. The onboard position assignment unit 17 assigns one onboard position to one movable body 4 based on the destination floor of the movable body 4. The communication unit 14 transmits the information indicative of the onboard position assigned to the movable body 4 by the onboard position assignment unit 17 to the movable body 4. Consequently, according to Embodiment 1, it is possible to reduce time required for the movable body 4 to board or alight from the car 1 more reliably. As a result, it is possible to improve the operation efficiency of the elevator.

In Embodiment 1, the movement control unit 5 moves the movable body 4 to the position indicated by the information transmitted from the communication unit 14, for example, automatically by operating the movement mechanism of the movable body 4. Consequently, according to Embodiment 1, it is possible to reduce time required for the movable body 4 that moves to the destination automatically to board or alight from the car 1. As a result, it is possible to improve the operation efficiency of the elevator.

In Embodiment 1, the display control unit 9 of the movable body 4 causes the information display unit 8 of the movable body 4 to display the information transmitted from the communication unit 14. The movement control unit 5 moves the movable body 4 by operating the movement mechanism of the movable body 4 based on, for example, the operation by the user on the movable body 4. Consequently, according to Embodiment 1, it is possible to reduce time required for the movable body 4 controlled by the user on the movable body 4 to board or alight from the car 1. As a result, it is possible to improve the operation efficiency of the elevator.

In Embodiment 1, the position confirmation unit 18 determines whether or not the onboard position assigned to the movable body 4 by the onboard position assignment unit 17 is different from the position of the movable body 4 detected by the onboard position detection unit 13. In the case where the position confirmation unit 18 determines that the onboard position assigned to the movable body 4 is different from the detected position of the movable body 4, the communication unit 14 transmits at least the information indicative of the assigned onboard position to the movable body 4. Consequently, according to Embodiment 1, in the case where the onboard position of the movable body 4 controlled by the user on the movable body 4 is wrong, it is possible to call the attention of the user. As a result, it is possible to improve the operation efficiency of the elevator.

In Embodiment 1, when the onboard position assignment unit 17 assigns the onboard positions in the same car 1 to a plurality of the movable bodies 4, the onboard position assignment unit 17 assigns the onboard position closer to the door 12 of the car 1 to the movable body 4 having the floor at which the car 1 arrives earlier as the destination floor. Consequently, according to Embodiment 1, it is possible to reduce time required for the movable body 4 to alight from the car 1 more reliably. As a result, it is possible to improve the operation efficiency of the elevator.

In Embodiment 1, the onboard position update unit 19 changes the onboard position assigned to the movable body 4 having the floor at which the car 1 of the elevator stops next as the destination floor to another onboard position closer to the door 12 of the car 1. The communication unit 14 transmits the information indicative of the onboard position after the change to the movable body 4 whose assigned onboard position is changed by the onboard position update unit 19. Consequently, according to Embodiment 1, it is possible to optimize the placement of the movable bodies 4 in the car 1 in accordance with the situation in the car 1. As a result, it is possible to improve the operation efficiency of the elevator.

In Embodiment 1, in the case where the movable body 4 having the floor at which the car 1 of the elevator stops next as the destination floor is in the car 1, the waiting position determination unit 20 determines that the position other than the position in front of the door of the hall 3 is the waiting position. The communication unit 14 transmits the information indicative of the waiting position determined by the waiting position determination unit 20 to the movable body 4 that is present in the hall 3 of the floor at which the car 1 stops next. Consequently, according to Embodiment 1, it is possible to prevent the movable body 4 that waits in the hall 3 from hindering the movable body 4 in the car 1 from alighting from the car 1. As a result, it is possible to improve the operation efficiency of the elevator.

In Embodiment 1, the traveling direction prediction unit 21 predicts the direction in which the movable body 4 travels after alighting from the car 1 of the elevator. The waiting position determination unit 20 determines that, for example, the position in the direction different from the direction predicted by the traveling direction prediction unit 21 is the waiting position. Consequently, according to Embodiment 1, it is possible to prevent the movable body 4 that waits in the hall 3 from hindering the movement of the movable body 4 after the movable body 4 alights from the car 1. As a result, it is possible to improve the operation efficiency of the elevator.

In Embodiment 1, in the case where the movable body 4 having the floor at which the car 1 of the elevator stops next as the destination floor is not in the car 1, the waiting position determination unit 20 determines that the position in front of the door of the hall 3 is the waiting position. Consequently, according to Embodiment 1, it is possible to reduce time required for the movable body 4 to board the car 1. As a result, it is possible to improve the operation efficiency of the elevator.

In Embodiment 1, the communication unit 14 of the elevator control device 2 may transmit information that identifies the user on another movable body 4 to which the onboard position in the car 1 assigned to the call based on the destination floor information transmitted from the movable body 4 is assigned to the movable body 4. In this case, the communication unit 14 of the elevator control device 2 transmits the content of the onboard map of the car 1 stored in the data storage unit 16 to the communication unit 7 of the movable body 4 after the car 1 is assigned by the car assignment unit 15. The display control unit 9 of the movable body 4 causes the information display unit 8 to display the content of the onboard map. With this, information indicating who will be positioned near the onboard position of the movable body 4 is disclosed in advance, and hence it is possible to eliminate the anxiety of the user on the movable body 4.

In Embodiment 1, the onboard position assignment unit 17 may assign the onboard position desired by the user on the movable body 4 to the movable body 4. In this case, for example, the user inputs the onboard position in the onboard position request unit 10 of the movable body 4 on which the user is. The onboard position request unit 10 generates request information indicative of the onboard position specified based on the input operation by the user on the movable body 4. The communication unit 7 of the movable body 4 transmits the request information generated by the onboard position request unit 10 to the communication unit 14 of the elevator control device 2. The communication unit 14 of the elevator control device 2 receives the request information transmitted from the movable body 4. The onboard position assignment unit 17 assigns the onboard position indicated by the request information received from the movable body 4 by the communication unit 14 to the movable body 4. With this, the user can be positioned at the desired onboard position in the car 1. In addition, when the onboard map of the car 1 is disclosed in advance, the user can be positioned at the onboard position adjacent to another user with whom the user wants to take the elevator, or the user can be positioned at the onboard position away from another user with whom the user doesn't want to take the elevator. As a result, it is possible to improve the comfort of the user.

Figure 3:
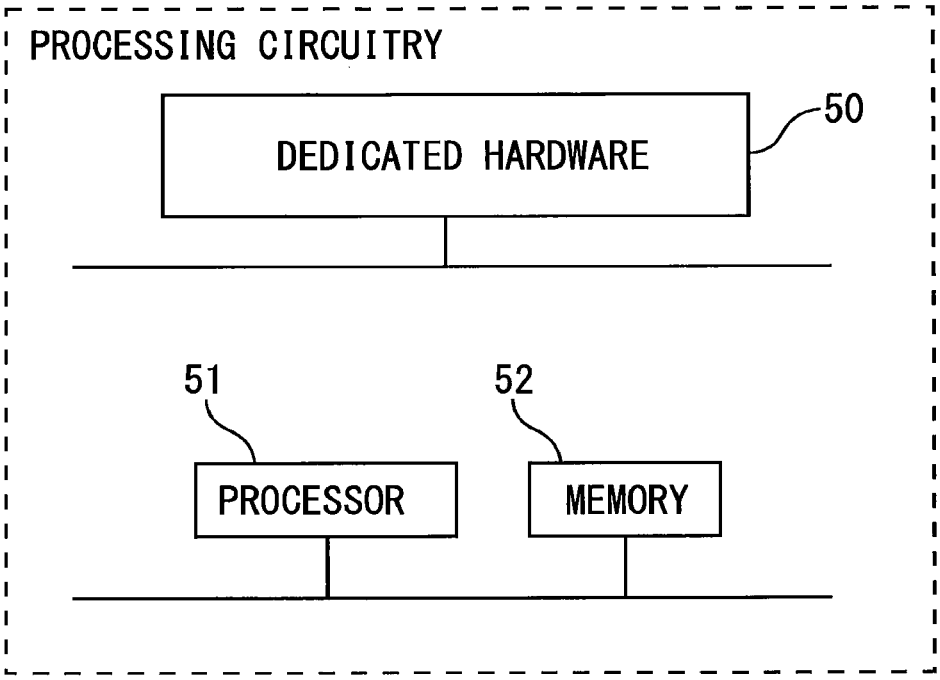
FIG. 3 is a hardware configuration diagram of the elevator system.

FIG. 3 is a hardware configuration diagram of the elevator system.

The individual functions of the communication unit 14, the car assignment unit 15, the data storage unit 16, the onboard position assignment unit 17, the position confirmation unit 18, the onboard position update unit 19, the waiting position determination unit 20, and the traveling direction prediction unit 21 in the elevator control device 2 are implemented by a processing circuitry. The processing circuitry may be dedicated hardware 50. The processing circuitry may include a processor 51 and a memory 52. Part of the processing circuitry may be formed as the dedicated hardware 50, and the processing circuitry may further include the processor 51 and the memory 52. FIG. 3 shows an example in the case where part of the processing circuitry is formed as the dedicated hardware 50, and the processing circuitry includes the processor 51 and the memory 52.

In the case where at least part of the processing circuitry is at least one dedicated hardware 50, the processing circuitry corresponds to, for example, a single circuit, a composite circuit, a programmed processor, a parallel-programmed processor, an ASIC, an FPGA, or a combination thereof.

In the case where the processing circuitry includes at least one processor 51 and at least one memory 52, the individual functions of the communication unit 14, the car assignment unit 15, the data storage unit 16, the onboard position assignment unit 17, the position confirmation unit 18, the onboard position update unit 19, the waiting position determination unit 20, and the traveling direction prediction unit 21 are implemented by software, firmware, or a combination of software and firmware. The software and the firmware are described as programs, and the programs are stored in the memory 52. The processor 51 implements the functions of the individual units by reading and executing the programs stored in the memory 52. The processor 51 is also referred to as a CPU (Central Processing Unit), a central processor, a processing unit, an arithmetic unit, a microprocessor, a microcomputer, or a DSP. The memory 52 corresponds to, for example, a non-volatile or volatile semiconductor memory such as a RAM, a ROM, a flash memory, an EPROM, or an EEPROM, a magnetic disk, a flexible disk, an optical disk, a compact disc, a minidisc, or a DVD.

Thus, the processing circuitry can implement the individual functions of the elevator control device 2 by the hardware, the software, the firmware, or the combination thereof. Note that the individual functions of the movement control unit 5, the destination floor registration unit 6, the communication unit 7, the information display unit 8, the display control unit 9, and the onboard position request unit 10 in the movable body 4 are also implemented by a processing circuitry similar to the processing circuitry shown in FIG. 3.

INDUSTRIAL APPLICABILITY

Thus, the present invention can be applied to the elevator including the car that allows the movable body to board and alight from the car.

REFERENCE SIGNS LIST

1 Car
2 Elevator control device
3 Hall
4 Movable body
5 Movement control unit
6 Destination floor registration unit
7 Communication unit
8 Information display unit
9 Display control unit
10 Onboard position request unit
11 Waiting position detection unit
12 Door
13 Onboard position detection unit
14 Communication unit
15 Car assignment unit
16 Data storage unit
17 Onboard position assignment unit
18 Position confirmation unit
19 Onboard position update unit
20 Waiting position determination unit
21 Traveling direction prediction unit
50 Dedicated hardware
51 Processor
52 Memory

The invention claimed is:

1. An elevator system comprising:

first processing circuitry to receive destination floor information transmitted from a movable body having a movement mechanism and second processing circuitry, the movable body being boardable and alightable from a car of an elevator, to assign the car, in which a plurality of onboard positions are set, to a call based on the destination floor information received, and to assign one of the plurality of onboard positions to one movable body based on a destination floor of the movable body, wherein the first processing circuitry transmits to the movable body, information indicative of the onboard position assigned to the movable body.

2. The elevator system according to claim 1, wherein the second processing circuitry moves the movable body to a position indicated by the information transmitted from the first processing circuitry by operating the movement mechanism of the movable body.

3. The elevator system according to claim 1, wherein the second processing circuitry displays, on a display, the information transmitted from the first processing circuitry, and the second processing circuitry moves the movable body by operating the movement mechanism of the movable body based on an operation by a user on the movable body.

4. The elevator system according to claim 1, further comprising:

an onboard position detector provided in the car of the elevator, the onboard position detector to detect a position of the movable body in the car, wherein the first processing circuitry determines whether or not the onboard position assigned to the movable body is different from the position of the movable body detected by the onboard position detector, and the first processing circuitry transmits at least the information indicative of the onboard position assigned to the movable body in a case where the first processing circuitry determines that the onboard position assigned to the movable body is different from the detected position of the movable body.

5. The elevator system according to claim 1, wherein when the first processing circuitry assigns the onboard positions in the same car to a plurality of the movable bodies, the first processing circuitry assigns the onboard position closer to a door of the car to the movable body having a floor, at which the car arrives earlier, as a destination floor.

6. The elevator system according to claim 5, wherein the first processing circuitry changes the onboard position assigned to the movable body having a floor, at which the car of the elevator stops next, as the destination floor to another onboard position closer to the door of the car, and the first processing circuitry transmits information indicative of the onboard position after the change to the movable body, the assigned onboard position of which has been changed.

7. The elevator system according to claim 1, wherein the first processing circuitry determines that a position other than a position in front of a door of a hall is a waiting position in a case where the movable body having the floor, at which the car of the elevator stops next, as the destination floor is in the car, and the first processing circuitry transmits information indicative of the waiting position determined to the movable body present in the hall of the floor at which the car stops next.

8. The elevator system according to claim 7, wherein the first processing circuitry predicts a direction in which the movable body travels after alighting from the car of the elevator, and the first processing circuitry determines that a position in a direction different from the direction predicted is the waiting position.

9. The elevator system according to claim 7, wherein the first processing circuitry determines that the position in front of the door of the hall is the waiting position in a case where the movable body having the floor, at which the car of the elevator stops next, as the destination floor is not in the car.

10. The elevator system according to claim 1, wherein the first processing circuitry transmits to the movable body information indicative of a user on another movable body to which the onboard position in the car assigned to the call based on the destination floor information transmitted from the movable body is assigned.

11. The elevator system according to claim 1, wherein the second processing circuitry generates request information indicative of the onboard position specified, based on an operation by a user on the movable body, the first processing circuitry receives the request information generated by the second processing circuitry from the movable body, and the first processing circuitry assigns to the movable body the onboard position indicated by the request information received from the movable body.

12. A method for an elevator system, the method comprising:

receiving, by first processing circuitry, destination floor information transmitted from a movable body having a movement mechanism and second processing circuitry, the movable body being boardable and alightable from a car of an elevator;

assigning, by the first processing circuitry, the car, in which a plurality of onboard positions are set, to a call based on the destination floor information received;

assigning, by the first processing circuitry, one of the plurality of onboard positions to one movable body based on a destination floor of the movable body; and transmitting, by the first processing circuitry, to the movable body, information indicative of the onboard position assigned to the movable body.

* * * * *